United States Patent [19]

Klaus

[11] 4,067,127

[45] Jan. 10, 1978

[54] DETACHABLE LABEL HOLDER

[75] Inventor: Gerald R. Klaus, St. Charles, Ill.

[73] Assignee: Fellowes Manufacturing Company, Franklin Park, Ill.

[21] Appl. No.: 737,714

[22] Filed: Nov. 1, 1976

[51] Int. Cl.[2] ..... G09F 3/18

[52] U.S. Cl. ..... 40/16.4; 40/325

[58] Field of Search ..... 40/16 R, 16.2, 16.4, 40/16.6, 10, 325

[56] References Cited

U.S. PATENT DOCUMENTS

| | | | |
|---|---|---|---|
| 892,398 | 7/1908 | Canham | 40/16.4 X |
| 2,688,201 | 9/1954 | Troendle | 40/16 R |

FOREIGN PATENT DOCUMENTS

| | | | |
|---|---|---|---|
| 358,564 | 1/1962 | Switzerland | 40/16.2 |
| 1,019,904 | 2/1966 | United Kingdom | 40/16.4 |

*Primary Examiner*—Louis G. Mancene
*Assistant Examiner*—Wenceslao J. Contreras
*Attorney, Agent, or Firm*—Roy E. Hofer

[57] ABSTRACT

A detachable label holder for an open-ended compartment includes a U-member and an arm secured to the free end of one leg thereof. A suitable compartment has a multilayered wall with an opening in the innermost layer so that a leg of the U-member may be inserted into the opening and slid toward the open end of the compartment, whereby the base of the U-member engages the rear edge of the opening in the layer. The arm includes a label holder means.

6 Claims, 4 Drawing Figures

FIG. 1
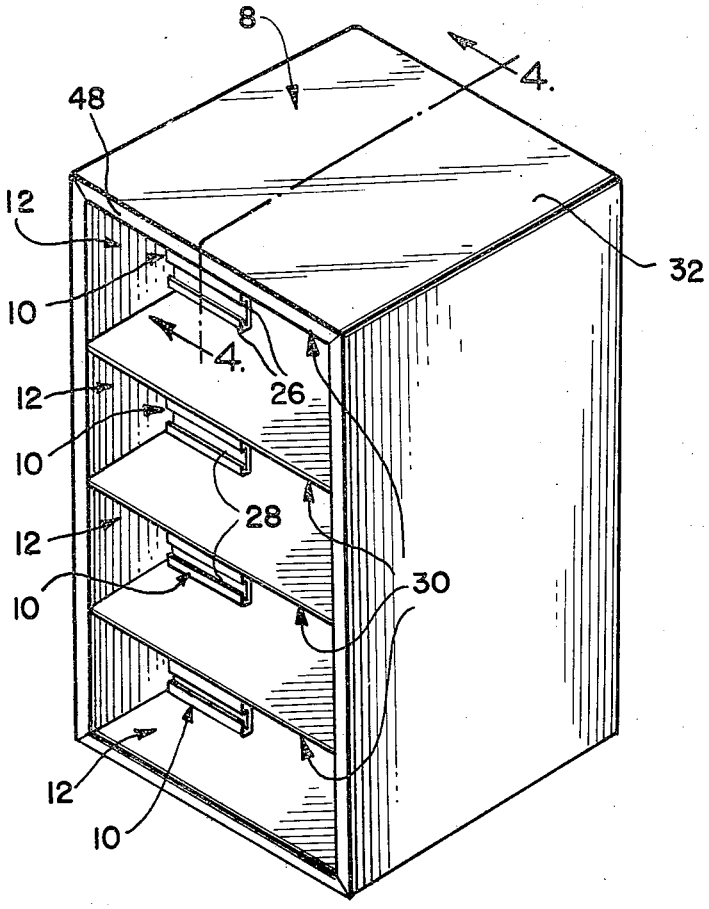
FIG. 3
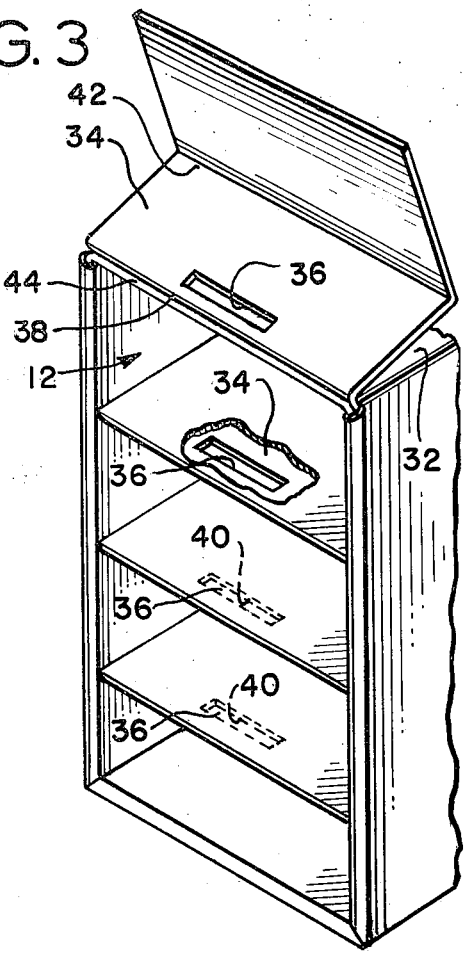
FIG. 2
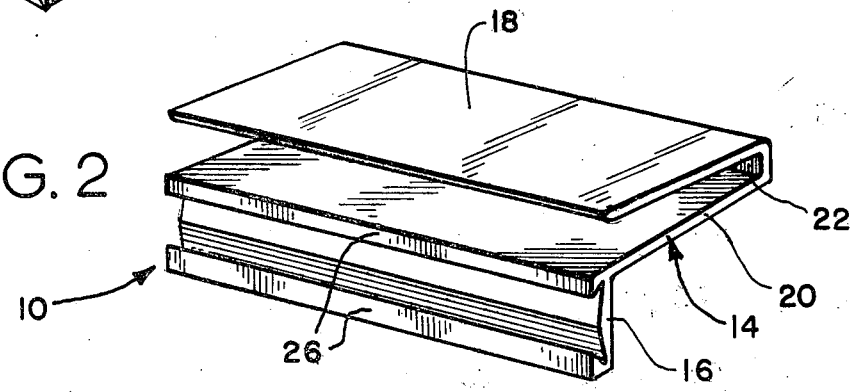
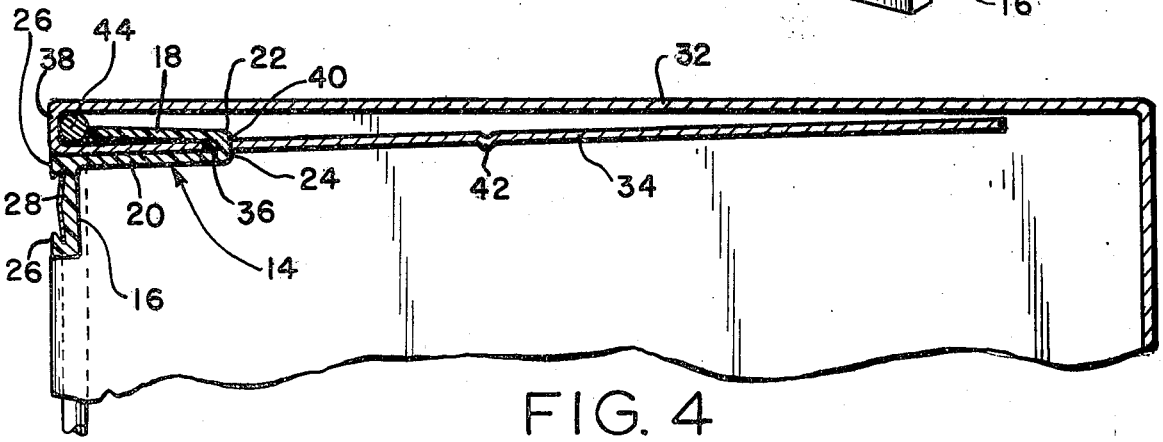
FIG. 4

DETACHABLE LABEL HOLDER

BACKGROUND OF THE INVENTION

The present invention is directed toward a detachable label holder for an open-ended compartment including means for securing the label holder thereto. Integral units which combine a label holder with a means for securing to the structure to be labeled are described in U.S. Pat. Nos. 3,883,255, 3,238,656 and 3,338,649. The label holders disclosed in these patents all require additional mounting apparatus on the compartment or panel to be labeled.

Offices which store large volumes of records often find it advantageous to use lightweight, easily assembled storage cabinets or units instead of rigid file cabinets made of metal or wood which are frequently not easily assembled or disassembled and are relatively heavy and therefore not easily moved.

Filing compartments constructed of relatively lightweight corrugated fiberboard are now being extensively used for storage. These compartments are easy to assemble and disassemble yet are sufficiently rigid to maintain their integrity and support the weight of the materials being stored within. It is this type of cabinet or compartment that is contemplated for use in conjunction with the label holder of the present invention.

Compartments constructed of corrugated fiberboard are not easily adapted for mounting conventional label holders thereon. The construction material is not sufficiently rigid to provide retaining means for conventional label holders. Use of separate retaining means of a more rigid material usually requires conventional mounting means such as screws or staples which perforate the wall of the compartment, resulting in a weakened construction.

It is important that label holders for corrugated fiberboard compartments be easily attached and detached without requiring the use of mounting means that would weaken the construction of the walls to which it is applied. It is also important that these label holders be easily removed and yet sufficiently secured to avoid accidental dislodgement during use of the compartment.

The general object of the invention is to provide a label holder including a label holder and securing means that can be easily attached and detached without additional mounting apparatus for a compartment constructed of corrugated fiberboard. A further object is to provide a label holder that when attached to a suitable compartment cannot be accidentally dislodged and yet is easily detachable.

SUMMARY OF THE INVENTION

These and other objects are accomplished by the present invention which provides a detachable label holder for compartments constructed of corrugated fiberboard which label holder includes a label holding means and a means for securing the unit to the compartment. The present invention further provides an improved label holder and securing means which not only secures the device to a wall of a compartment but also prevents accidental dislodgement of the label holder under normal use while allowing the label holder to be easily detached when desired.

A compartment suitable for use with the label holder is envisioned as being at least partially open at one end. The compartment wall upon which the label holder is mounted has at least two layers, capable of being separated, the innermost layer having an opening or a slot, providing a pocket between the layers.

The label holder includes generally first a U-shaped member securing means, one leg of which is adapted to be sandwiched between the compartment wall layers. A label holding means is positioned on an arm attached to the free end of the other leg. The base of the U-member engages the edge of the opening in the wall, preventing accidental dislodgement.

The invention and its objects, method of operation, features and advantages will be more fully understood by reference to the following drawings and detailed description.

DESCRIPTION OF THE DRAWINGS

FIG. 1 is a perspective view of a storage cabinet having a plurality of compartments upon which are mounted label holders embodying the present invention;

FIG. 2 is a perspective view of the label holder shown in FIG. 1;

FIG. 3 is a partial perspective view of the storage cabinet of FIG. 1 illustrating one of the compartments in a disassembled form; and FIG. 4 is a fragmentary sectional view taken along line 4—4 of FIG. 1 illustrating the manner in which the label holder of the present invention is secured to an inner wall of a suitable compartment.

DETAILED DESCRIPTION OF THE INVENTION

With reference to the drawings, there is shown in FIG. 1 a storage cabinet 8 having a plurality of compartments 12 each of which have a label holder 10 embodying the features of the present invention. The storage cabinet 8 with its separate compartments 12 is useful for orderly storage of papers, small objects and the like. The label holders 10 each display a card or label which identifies the contents of the separate compartments 12.

Referring now to FIGS. 2 to 4, the label holder 10 includes a U-member, designated generally by reference numeral 14, and an arm 16. The U-member 14 includes a first leg member 18, a second leg member 20 and a base 22 which interconnects the leg members 18 and 20 at one end of each.

The arm 16 is positioned on the second leg member 20 at the end opposite the base 22 and is shown extending substantially perpendicularly from the second leg member 20 in a direction opposite the first leg member 18. It is to be understood that arm 16 positioned at the free end of leg 20 may extend therefrom at any convenient angle such that the arm 16 is not obstructed from view by the compartment 12. Further, the distance the arm 16 extends downward is such that it does not obstruct access to the compartment 12. Suitable configurations of the arm 16 are well known to one of ordinary skill in the art and selection of a suitable arm is within the ordinary skill of one in the art.

A label holding means 26 is positioned on the arm 16 and is adapted to retain a card or label 28 which can identify the contents of the compartment 12. The label holding means 26 is illustrated as two opposed notches or flanges in FIGS. 1, 2, 3 and 4 which extend the breadth of the arm 16. Any suitable label holding means can be used, the selection of which is within the ordinary skill of one in the art.

The label holder 10 is secured to a compartment wall, designated generally by the reference numeral 30, which compartment wall 30 includes at least two layers, an outer layer 32 and an inner layer 34 and a forward edge 38. The inner layer 34 contains an opening or slot 36 at a distance from the forward edge 38 of the wall 30 substantially equal to the length of the first leg 18 of the label holder 10. Layers 32 and 34, at least along their length between the forward edge 38 and the slot 36, are not permanently secured to one another.

The first leg 18, when inserted into slot 36 and slid forwardly between the layers 32 and 34 toward the forward edge 38, as shown in FIG. 4, is sandwiched between layers 32 and 34. The base 22 of the U-member 14 abuts and frictionally engages the slot 36 along the rear edge 40 of the slot. The base 22 has a bottom surface 24 of any suitable configuration such as flat or curved inwardly. The selection of a suitable bottom surface 24 is within the ordinary skill of one in the art. However a label holder 10 with a flat base bottom surface 24 is a preferred embodiment of the invention and provides a label holder 10 which can be attached or detached from the compartment wall 30 with great ease. The second leg member 20 is aligned along the outer surface of layer 34 and extends toward the end 38, positioning the arm 16 below or near the edge 38. The U-member 14, so secured, positions the label holding means 26 near the open end of the compartment 12.

The compartment 12, as best seen in FIG. 3, may have a fold or crease 42 along the inner layer 34 which facilitates assembly or disassembly of the compartment 12. The inner layer 34 is preferably in its extended position when assembled. The compartment 12 may also have a support rod 44 positioned between layers 32 and 34 near the forward edge 38 when the compartment 12 is assembled. The length of the first leg 18 which is sandwiched between the layers 32 and 34 will preferably be adapted to prevent the support rod 44 from being an obstruction, for example by having the first leg 18 of a lesser length than the second leg 20.

The label holder 10 of the present invention may be constructed of virtually any material that is sufficiently flexible to allow attachment and detachment to a compartment wall 30 as described above. A preferred material is a plastic of medium density.

It should be understood that the label holder 10 of the present invention may be adapted for use with compartments 12 constructed from virtually any material so long as at least one layer along the length between the slot 36 in the inner layer 34 and the forward edge 38 of the compartment wall 30 is sufficiently flexible to allow insertion of the first leg member 18 of the label holder 10.

I claim:

1. An open-ended storage compartment comprising, in combination:

1. a compartment including;
- at least one open-end; and
- a plurality of walls adjacent said open-end;
- at least one of said walls having at least a first and a second layer;
- said first and second layer being adjacent one to another;
- said first layer including a slot and being separable from said second layer at least along its length from said slot to said open-end; and

2. at least one detachable label holder including;
- a generally U-shaped member including a first leg, a second leg and a base;
- said first leg being positioned between said first and second layers and extending from the slot toward said open-end; and
- an arm on said second leg disposed near said open-end, said arm including a label holding means;
- whereby said label holder may be attached and detached from said storage compartment without additional mounting apparatus.

2. The storage compartment of claim 1 wherein said base of said U-shaped member abuts an edge of said slot whereby accidental dislodgement of said label holder from said compartment is restrained.

3. The storage compartment of claim 2 wherein the base member has a substantially flat bottom.

4. The storage compartment of claim 2 wherein the base member has an inwardly curved bottom.

5. The storage compartment of claim 1 wherein said arm extends perpendicular to said second leg member in a direction opposite said first leg member.

6. The storage compartment of claim 1 wherein the label holding means are two opposed flanges extending substantially the breadth of the arm.

* * * * *